US011619441B2

(12) United States Patent
Yeom

(10) Patent No.: US 11,619,441 B2
(45) Date of Patent: Apr. 4, 2023

(54) REFRIGERATOR AND CONTROL METHOD FOR OPENING REFRIGERATOR DOOR

(71) Applicant: LG Electronics Inc., Seoul (KR)

(72) Inventor: Tae Jin Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 273 days.

(21) Appl. No.: 17/010,389

(22) Filed: Sep. 2, 2020

(65) Prior Publication Data

US 2021/0063080 A1 Mar. 4, 2021

(30) Foreign Application Priority Data

Sep. 3, 2019 (KR) ..... 10-2019-0108967

(51) Int. Cl.

| | |
|---|---|
| ***F25D 23/02*** | (2006.01) |
| ***F25D 29/00*** | (2006.01) |
| ***F21V 23/04*** | (2006.01) |
| ***F25D 25/04*** | (2006.01) |
| ***F25D 27/00*** | (2006.01) |
| *F21W 131/305* | (2006.01) |
| *F25D 11/02* | (2006.01) |

(52) U.S. Cl.

CPC ..... *F25D 29/005* (2013.01); *F21V 23/0471* (2013.01); *F25D 23/028* (2013.01); *F25D 25/04* (2013.01); *F25D 27/005* (2013.01); *F21W 2131/305* (2013.01); *F25D 11/02* (2013.01); *F25D 29/00* (2013.01); *F25D 2327/001* (2013.01); *F25D 2700/04* (2013.01)

(58) Field of Classification Search

CPC ..... F25D 23/028; F25D 25/04; F25D 27/005; F25D 29/005; F25D 2700/04

See application file for complete search history.

(56) References Cited

U.S. PATENT DOCUMENTS

| | | | | |
|---|---|---|---|---|
| 8,457,795 | B1 * | 6/2013 | Rubin | F25D 29/003 700/275 |
| 9,377,238 | B2 | 6/2016 | Hall et al. | |
| 2018/0038634 | A1 | 2/2018 | Kim et al. | |

FOREIGN PATENT DOCUMENTS

| | | | | |
|---|---|---|---|---|
| CN | 107076509 | | 8/2017 | |
| JP | 2002090059 | | 3/2002 | |
| JP | 2006032050 | | 2/2006 | |
| KR | 1020130071919 | | 7/2013 | |
| KR | 1020180138083 | | 12/2018 | |
| WO | WO2014159375 | | 10/2014 | |
| WO | WO2015131780 | | 9/2015 | |
| WO | WO-2015131780 | A1 * | 9/2015 | F25D 23/02 |

(Continued)

OTHER PUBLICATIONS

CN 106796077 (English Translation) (Year: 2017).*

(Continued)

*Primary Examiner* — Jonathan Bradford

(74) *Attorney, Agent, or Firm* — Fish & Richardson P.C.

(57) ABSTRACT

A refrigerator includes a cabinet that defines a storage space therein, a door configured to open and close at least a portion of the storage space, and a user detection sensor disposed at a first side of the door with respect to a center line crossing a width direction of the door and configured to detect a user. The user detection sensor is inclined with respect to a front surface of the door by a predetermined angle to thereby face toward the center line.

22 Claims, 8 Drawing Sheets

(56) References Cited

FOREIGN PATENT DOCUMENTS

WO WO2017113643 7/2017

OTHER PUBLICATIONS

Office Action in Chinese Appln. No. 202010877331.9, dated Nov. 11, 2021, 16 pages (with English translation).
EP Extended European Search Report in European Appln. No. 20192402.4, dated Dec. 11, 2020, 7 pages.
Office Action in Chinese Appln. No. 202010877331.9, dated Aug. 5, 2022, 5 pages.

* cited by examiner

REFRIGERATOR AND CONTROL METHOD FOR OPENING REFRIGERATOR DOOR

CROSS REFERENCE TO RELATED APPLICATION

The present application claims priority to Korean Patent Application No. 10-2019-0108967, filed on Sep. 3, 2019, the entire contents of which are incorporated herein for all purposes by reference.

TECHNICAL FIELD

The present disclosure relates to a refrigerator configured to detect a user and a control method thereof.

BACKGROUND

A refrigerator is a household appliance that can store food at a low temperature in an internal storage space covered by a door.

For example, the refrigerator may maintain the stored food in an optimal state by cooling the inside of the storage space by using cold air generated through heat exchange with a refrigerant circulating in a refrigeration cycle.

The storage space of a refrigerator may be opened and closed by a door. The refrigerator may be classified into various types of refrigerators according to the arranged shape of the storage space and the structure of a door opening and closing the storage space.

The door of a refrigerator may be classified into a swinging door that opens and closes the storage space by being hingedly rotated, and a drawer-type door (hereinafter, referred to as a drawer) that opens and closes the storage space and move like a drawer.

In some examples, the drawer may be arranged at a lower area of a refrigerator, a user may pull a portion of the drawer by bending at the waist at an appropriate distance away from the drawer to open the drawer.

In some examples, a refrigerator may include a drawer that may be automatically opened.

In some cases, after the drawer is automatically opened, a user may bend at the waist to take out a basket or food. In some cases, a refrigerator may include a lifting device disposed under a basket.

For example, a refrigerator may include a lifting mechanism for the lifting and lowering of a bin provided in a refrigerating compartment.

The refrigerator may include various convenience functions to be multifunctional and intelligent. For example, the refrigerator may include functions to check the inside of a refrigerator without opening the door thereof, or to automatically perform a desired function by detecting a user's voice. In addition, internet of things (IoT) functions may be added to a refrigerator.

In some cases, a refrigerator may include a user interface to input a command by a user or display information for the user.

For instance, a refrigerator door may include a display manipulation part installed on the front thereof. The display manipulation part may include a manipulation panel having a display device and a manipulation button, a button part located at the rear of the manipulation panel and having a pressed part, and a printed circuit board located at the rear of the button part and having a light emitting diode (LED) installed therein. A user may manually touch and activate the display manipulation part so as to select desired function in the refrigerator.

SUMMARY

The present disclosure describes a refrigerator that may accurately detect a user who intends to use the refrigerator.

The present disclosure describes a refrigerator that can detect a user disposed in a detection area defined in front of the refrigerator.

The present disclosure also describes a refrigerator that has an installation space that receives a user detection sensor capable of detecting a user.

The present disclosure further describes a refrigerator including a button device configured to, based on a user being in front of the refrigerator, be activated to be manipulated by the user to automatically open at least one door or to automatically lift a container provided in the door.

According to one aspect of the subject matter described in this application, a refrigerator includes a cabinet that defines a storage space therein, a door configured to open and close at least a portion of the storage space, and a user detection sensor disposed at a first side of the door with respect to a center line crossing a width direction of the door and configured to detect a user. The user detection sensor is inclined with respect to a front surface of the door by a predetermined angle to thereby face toward the center line.

Implementations according to this aspect may include one or more of the following features. For example, the door may be configured to rotate about a rotation axis, and the user detection sensor may be located at an end of the door opposite to the rotation axis. In some examples, the door may include a door front panel disposed at the front surface of the door, and define a sensor space that receives the user detection sensor at a rear side of the door front panel of the door. The sensor space may include a sensor window that is defined at an inner side of the sensor space and faces the rear side of the door front panel. A front end of the user detection sensor may face the sensor window.

In some implementations, the door may further include a first side guide rib and a second side guide rib that are disposed inside the sensor space at positions corresponding to ends of the sensor window. The first side guide rib and the second side guide rib may extend parallel to each other and be inclined with respect to the rear side of the door front panel. The first side guide rib and the second side guide rib may support side surfaces of the front end of the user detection sensor.

In some examples, the door may further include a first rear end support rib and a second rear end support rib that are disposed inside the sensor space at positions rearward relative to the sensor window and that support a rear end of the user detection sensor. The first rear end support rib and the second rear end support rib may protrude from a rear surface of the sensor space toward the sensor window and having protrusion lengths different from each other. The door may further include a rear end holder that has a cantilever shape and holds the rear end of the user detection sensor.

In some implementations, the door may further include an interference avoidance inclining surface that is disposed adjacent to the second rear end support rib at the rear surface of the sensor space, and a mounting piece support end that is disposed at an end portion of the interference avoidance inclining surface. The user detection sensor may include a first-side mounting piece supported by the mounting piece support end in the sensor space, and a second-side mounting piece that is received in a holding channel defined at a side of the sensor space.

In some implementations, the door may define an interference avoidance opening at a portion of the mounting piece support end to thereby avoid interference between the user detection sensor and the mounting piece support end based on the user detection sensor being inserted into the sensor space.

In some implementations, the door may define an interference avoidance groove that is recessed from a ceiling of the sensor space such that an opposite surface of the interference avoidance groove protrudes away from the sensor space.

In some implementations, the refrigerator may include a button device disposed at a second side of the door and configured to open the door or lift a container disposed inside the door based on the user manipulating the button device. In some examples, the button device may be configured to be activated based on the user detection sensor detecting the user. In some examples, the button device may include a light emitter that is configured to be turned on and emit light based on the button device being activated.

In some examples, the light emitter may be configured to be turned off based on an elapse of a preset time without manipulation of the button device after the light emitter has been turned on the light emitter may be configured to maintain emission of the light based on manipulation of the button device after the light emitter is turned on, and to be turned off based on completion of opening of the door or lifting of the container. In some implementations, the light emitter may be configured to, based on the button device being manipulated after the light emitter is turned on, be repeatedly turned on and off while the door is being opened or the container is being lifted.

In some implementations, the refrigerator may include at least one of a speaker or a display. For example, the speaker or the display may be configured to, based on the button device being activated, output information indicating the activation of the button device.

According to another aspect, a method for controlling a refrigerator includes detecting presence of a user in an area around a door of the refrigerator by a user detection sensor that is arranged at a side of the door with respect to a center line crossing a width direction of the door, where the user detection sensor is inclined with respect to a front surface of the door by a predetermined angle to thereby face toward the center line. The method further includes, based on detecting the presence of the user, activating a button device that is configured to, based on the user manipulating the button device, open the door or lift a container disposed inside the door.

Implementations according to this aspect may include one or more of the following features. For example, the method may further include, based on the button device being activated, turning on a light emitter disposed in the button device to emit light. In some implementations, the method may include turning off the light emitter based on an elapse of a preset time without manipulation of the button device after the light emitter has been turned on.

In some implementations, the method may include maintaining the light emitter to emit the light based on the button device being manipulated after the light emitter is turned on, and turning off the light emitter based on completion of opening of the door or lifting of the container.

In some implementations, the method may further include, based on the button device being activated, outputting, through a speaker or a display, information indicating the activation of the button device.

In some implementations, when the button device is activated, the light emitter provided in the button device may be automatically turned on and emit light, which enables a user to easily and rapidly check and manipulate the button device.

In some implementations, the light emitter may be turned on, and then be automatically turned off under a specific condition, which may reduce unnecessary power consumption when the button device is not used.

DETAILED DESCRIPTION

Figure 1:
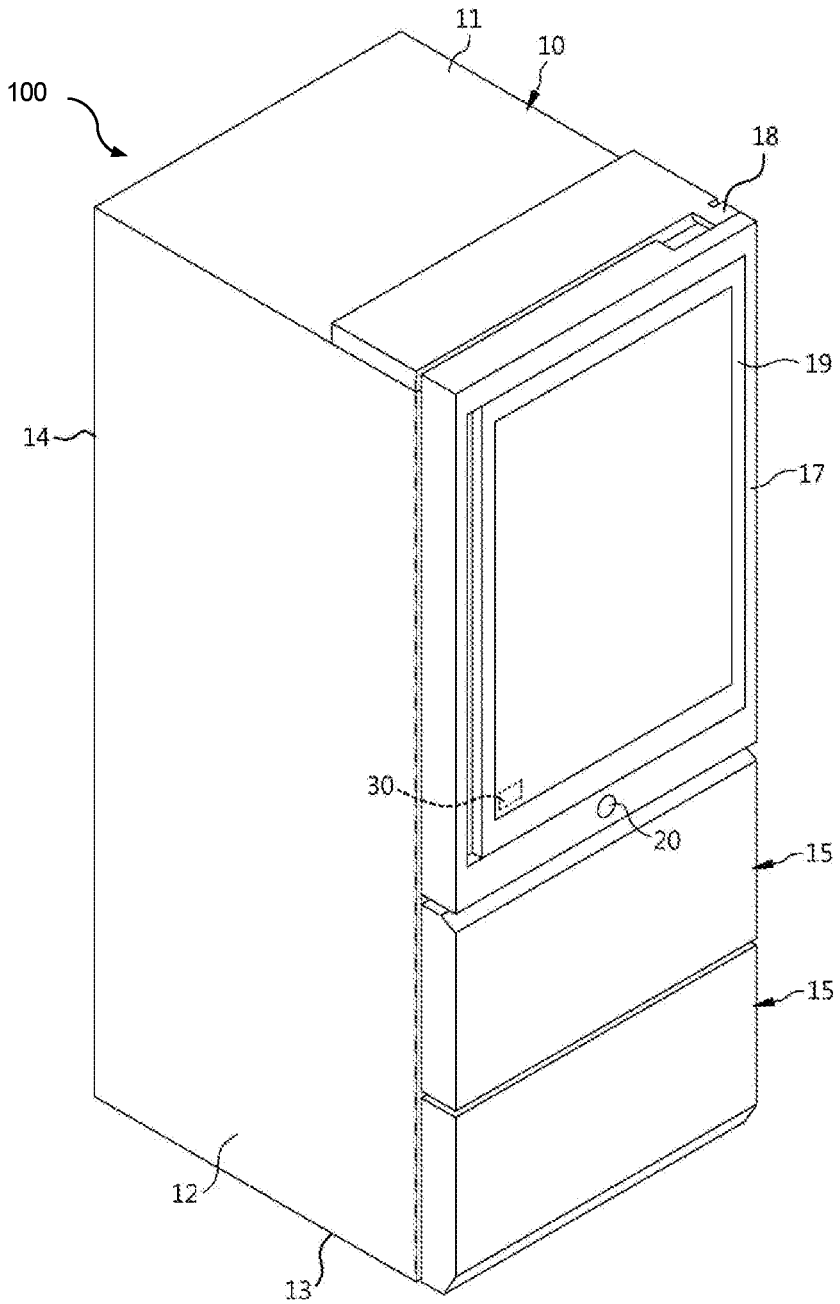
FIG. 1 is a perspective view of an example of a refrigerator.

The advantages and features of the present disclosure, and the way of achieving them will become apparent with reference to one or more implementations described below in detail together with the accompanying drawings. However, the present disclosure is not limited to the implementations disclosed below, but may be implemented in various different forms. The present implementations are provided only to make the disclosure of the present disclosure complete and to completely inform those skilled in the art to which the present disclosure belongs of the scope of the disclosure, and the present disclosure is only defined by the scope of the claims. The same reference numerals refer to the same components throughout the specification.

Hereinafter, a refrigerator of the present disclosure will be described in detail with reference to the accompanying drawings.

Figure 2:
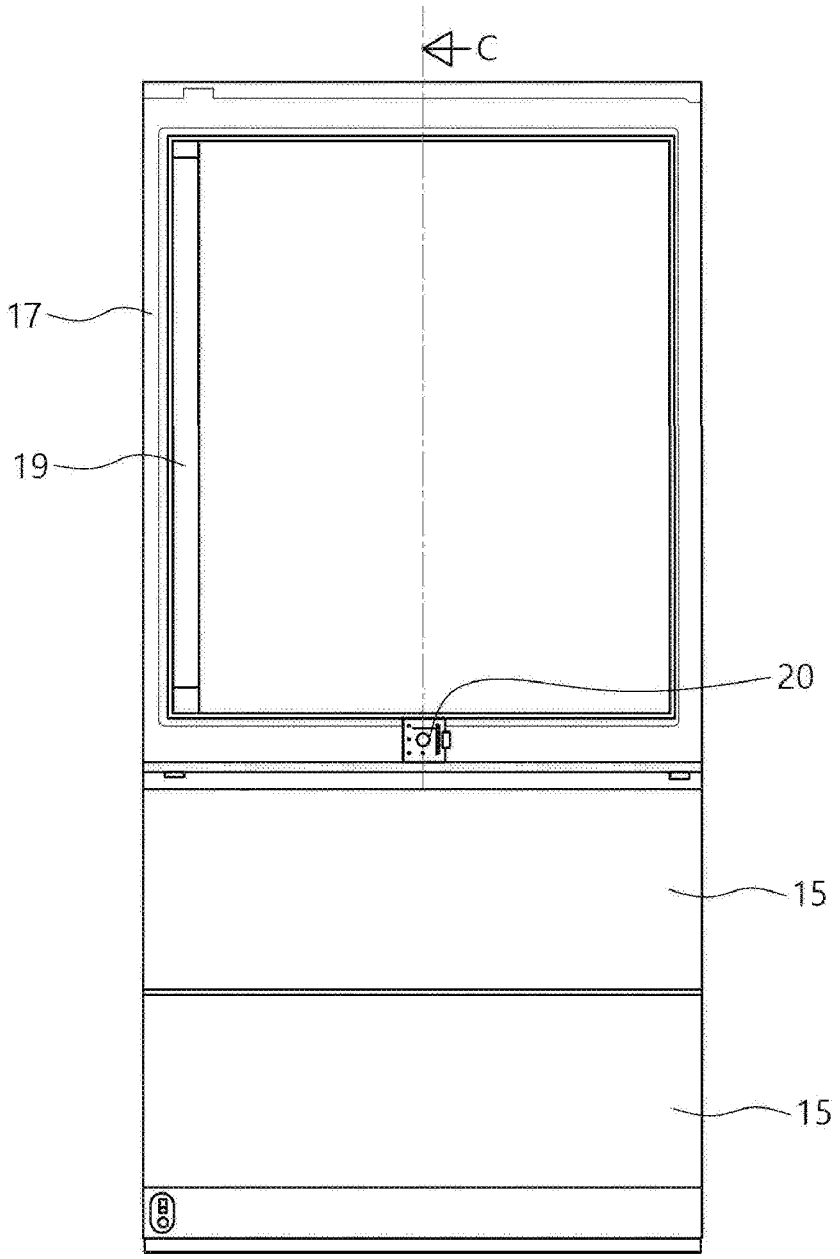
FIG. 2 is a front view of the refrigerator illustrated in FIG. 1.
Figure 3:
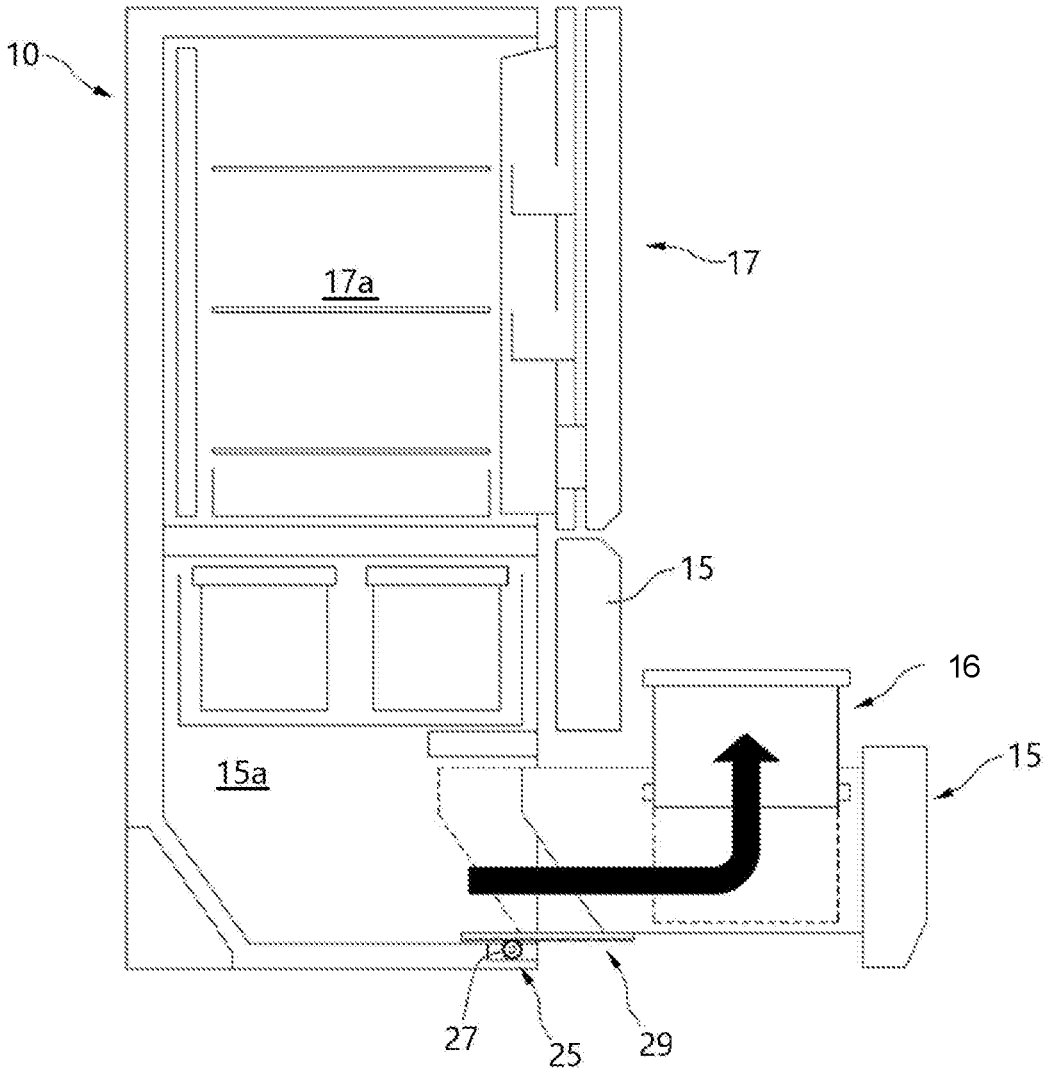
FIG. 3 is a view illustrating an opened state of an example drawer of the refrigerator of FIG. 1.
Figure 4:
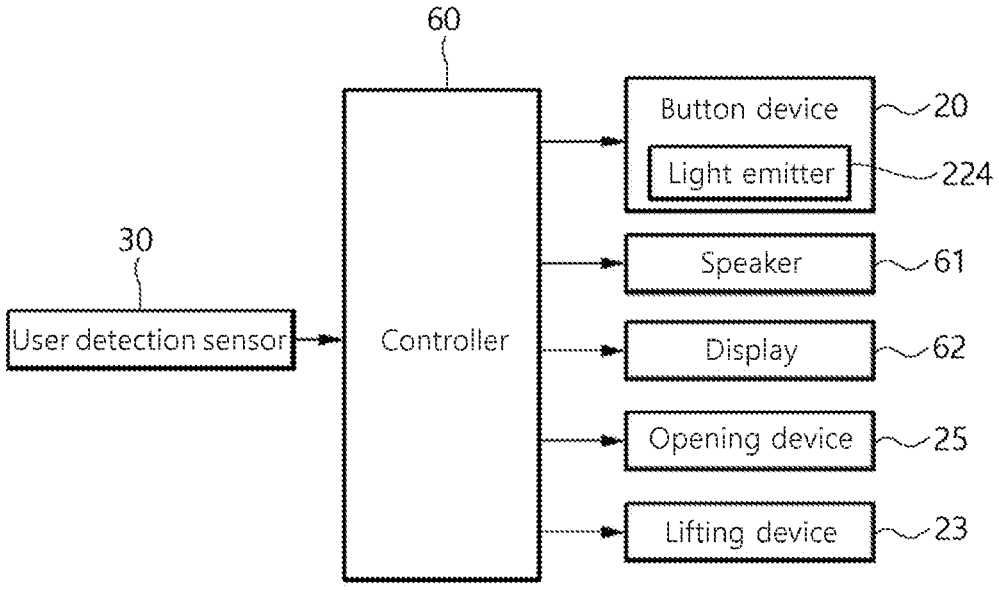
FIG. 4 is a block diagram of the refrigerator.

FIG. 1 is a perspective view of an example of a refrigerator. FIG. 2 is a front view of the refrigerator illustrated in FIG. 1. FIG. 3 is a view illustrating an opened state of an example drawer of the refrigerator of FIG. 1. FIG. 4 is a block diagram illustrating the refrigerator.

Referring to FIGS. 1 to 4, a refrigerator 100 may include a cabinet 10 that defines an appearance of the refrigerator 100. The cabinet 10 may have an approximate hexahedral shape having an open front surface. The storage space inside the cabinet 10 may be divided into multiple storage spaces.

A ceiling part 11 may define an upper portion of the cabinet 10, and two sidewall parts 12 may define opposite side surfaces of the cabinet 10. A bottom part 13 may define a bottom of the cabinet 10, and a rear surface part 14 may define the rear surface of the cabinet 10, so that the cabinet 10 may be formed in an approximate hexahedral shape having the open front surface.

The ceiling part 11, the sidewall parts 12, the bottom part 13, and the rear surface part 14 may have insulating layers made of insulating materials therein, so that the inside of the storage space is not affected by the outside.

The storage space may be divided into multiple spaces. For example, upper space 17*a* of the cabinet 10 may be used as a refrigerating compartment, and lower space 15*a* thereof may be used as a freezer compartment.

In some cases, the upper space and the lower space may be not the refrigerating compartment or the freezer compartment, but may be spaces independent of each other in which different temperatures are maintained.

The storage space may be opened and closed by a door. The door may include a swinging door 17, and a drawer-type door 15 (hereinafter, referred to as a drawer) opened.

For example, a relatively upper storage space of the storage space divided inside the cabinet 10 may be opened and closed by the swinging door 17. The swinging door 17 may be rotatably moved by a predetermined angle relative to a door hinge 18.

A separate inner door 19 may be provided in the swinging door 17. The inner door 19 is also called a home bar door. Transparent glass through which the inside of the inner door 19 may be seen from the outside may be installed on the front surface of the inner door 19, or a display that displays various information may be installed on the front surface thereof.

A button device 20 may be installed on a side of the swinging door 17. The button device 20 is intended to automatically open and close the drawer 15. The button device 20 is activated due to the detection of the presence of a user by a user detection sensor 30 to be described below, and when the user presses the activated button device, the drawer 15 may be automatically moved.

The lower space 15*a* may be opened and closed by the drawer 15. A storage space in which stored items are located is provided in the drawer 15, and may be opened and closed together with the drawer 15.

The lower space 15*a* may be divided up and down, and the drawer 15 may include an upper drawer and a lower drawer.

In the implementation of the present disclosure, the refrigerator in which the swinging door 17 and the drawer 15 are provided is described, but the present disclosure is not limited thereto. The present disclosure may be applied to all types of refrigerators having a door opened and closed like a drawer.

The refrigerator may further include an opening device 25 opening the drawer 15, and a lifting device 23 lifting and lowering a container 16 provided inside the drawer 15 when the drawer 15 is opened.

Hereinafter, an example in which the lower drawer 15 is opened by the opening device 25, and the container 16 received in the drawer 15 is lifted and lowered by the lifting device 23 will be described.

The opening device 25 may include a motor, a pinion gear 27 rotated by the motor, and a rack 29 meshing with the pinion gear 27.

The rack 29 is connected to the drawer 15, and is moved forward or rearward during the operation of the motor, so the drawer 15 may be opened and closed.

The lifting device 23 may include a support part supporting the container 16, a motor, and a power transmission part transmitting the power of the motor to the support part. In the implementation, the lifting device 23 may be implemented by a known technique, so a detailed description thereof will be omitted.

The refrigerator may further include the button device 20 by which an automatic opening/closing command of at least one drawer of the upper drawer 15 and the lower drawer 15 may be input.

The button device 20 may be activated when a user of a refrigerator is detected by the user detection sensor 30 to be described later. When the activated button device 20 is manipulated by the user, a controller 60 allows the opening device 25 and/or the lifting device 23 to be operated. In some examples, the controller 60 may include an electric circuit, one or more processors, a computer, or the like.

For example, when the button device 20 is manipulated with the button device 20 activated, the controller 60 operates the opening device 25, and allows the drawer 15 to be opened thereby.

When the opening of the drawer 15 is completed, the controller 60 operates the lifting device 23, and allows the container 16 in the opened drawer 15 to be lifted thereby.

In some implementations, a user allows the drawer 15 to be opened without manually opening the drawer 15, whereby convenience of the user may be improved.

In some examples, when the drawer 15 is opened, the container 16 may be automatically lifted, whereby the inconvenience that a user may manually take out the container 16 from the drawer 15 may be removed.

In some implementations, any one of the opening device 25 and the lifting device 23 may be omitted. For example, in the case that the refrigerator includes only the opening device 25, the drawer 15 may be opened by the opening device 25 when the button device 20 is manipulated.

Alternatively, in the case that the refrigerator includes only the lifting device 23, the drawer 15 may be opened by being manually slid, and the button device 20 may be manipulated when a sensor detects the completion of the opening of the drawer 15. In this case, the lifting device 23 is operated, and the container 16 may be automatically lifted.

In the implementation, the button device 20 may be located at a position higher than the position of the drawer 15 slidably opened.

The installation position of the button device 20 is not limited to a specific position, but as an example, the button device 20 may be provided in the swinging door 17 located above the drawer 15.

When the button device 20 is provided in the swinging door 17, a user can easily approach the button device 20. For example, a user can approach the corresponding button device 20 while the user is standing without bending at the waist.

In addition, the button device 20 may be located at the front surface of the swinging door 17 so that a user can easily manipulate the button device 20. In this case, the button device 20 may be located to be adjacent to the drawer 15 so that the user can easily and conveniently manipulate the button device 20.

The button device 20 may be located at the lower portion of the front surface of the swinging door 17. For example, the button device 20 may be located at the center of the lower portion of the front surface of the swinging door 17.

The refrigerator 100 may further include the user detection sensor 30.

When a detection signal is output by the user detection sensor 30 after a user is detected thereby, a light emitter 224 of the button device 20 to be described later may be turned on. When the light emitter 224 is turned on, the button device 20 may be activated.

When the button device 20 is activated, the controller 60 may output the information that the button device 20 is activated by using a speaker 61.

Alternatively, when the button device 20 is activated, the controller 60 may display the information that the button device 20 is activated by using the display 62.

The user detection sensor 30 may be a sensor detecting that a user is close to the refrigerator within a predetermined distance and a predetermined direction. Alternatively, the user detection sensor 30 may be an impact detection part detecting impact which a user applies to the swinging door 17.

The impact detection part, for example, may include a microphone that detects sound waves generated by the impact. Since the impact detection part may be implemented by a known technique, a detailed description thereof will be omitted.

In the implementation of the present disclosure, when the impact applied to the swinging door 17 is detected by the user detection sensor 30, the light emitter 224 of the button device 20 may be turned on.

In the implementation of the present disclosure, when the button device 20 is not manipulated until preset time has elapsed after the light emitter 224 is turned on, the light emitter 224 is turned off.

In addition, when the light emitter 224 is turned on, and the button device 20 is detected to be manipulated, the light emitter 224 is maintained to be turned on, and when the operation of the opening device 25 and/or the lifting device 23 is completed, the light emitter 224 is turned off.

When the light emitter 224 is turned on, and the button device 20 is detected to be manipulated in another implementation, the light emitter 224 may be repeatedly turned on and off until the operation of the opening device 25 and/or the lifting device 23 is completed.

To this end, in the implementation of the present disclosure, the refrigerator may include a timer therein to count the elapsed time.

In some implementations, the user detection sensor 30 may be installed in the swinging door 17. For example, the user detection sensor 30 may be installed at a lower portion of the left of the front surface of the swinging door 17. However, the present disclosure is not limited thereto, and the user detection sensor 30 may be installed at any position as long as the user detection sensor 30 can detect a user who intends to use the refrigerator.

Hereinafter, the user detection sensor 30 and space in which such a user detection sensor 30 is installed will be described in detail.

Figure 5:
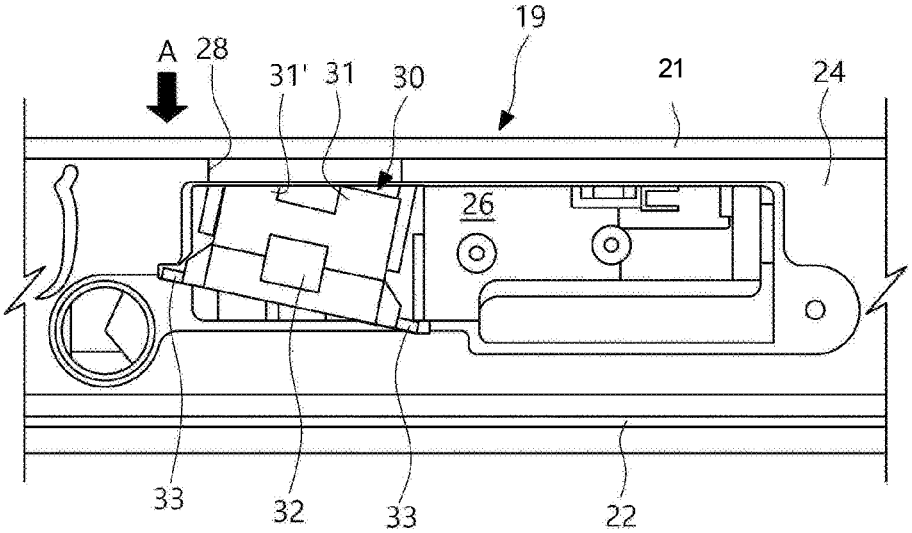
FIG. 5 is a bottom view illustrating a part of an example inner door viewed from the direction of arrow A.
Figure 6:
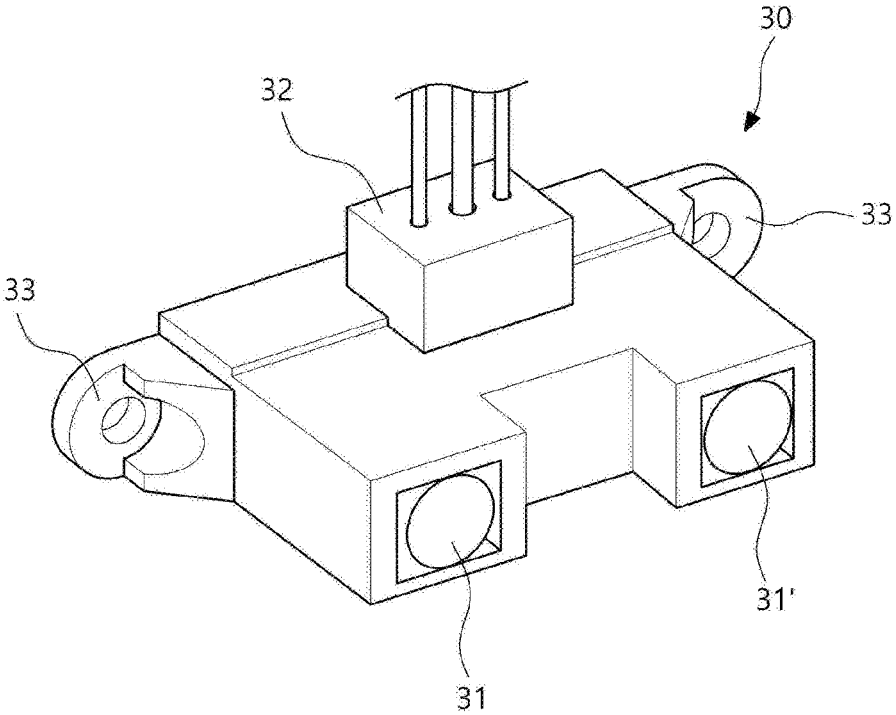
FIG. 6 is a perspective view illustrating an example of a user detection sensor of the refrigerator.
Figure 7:
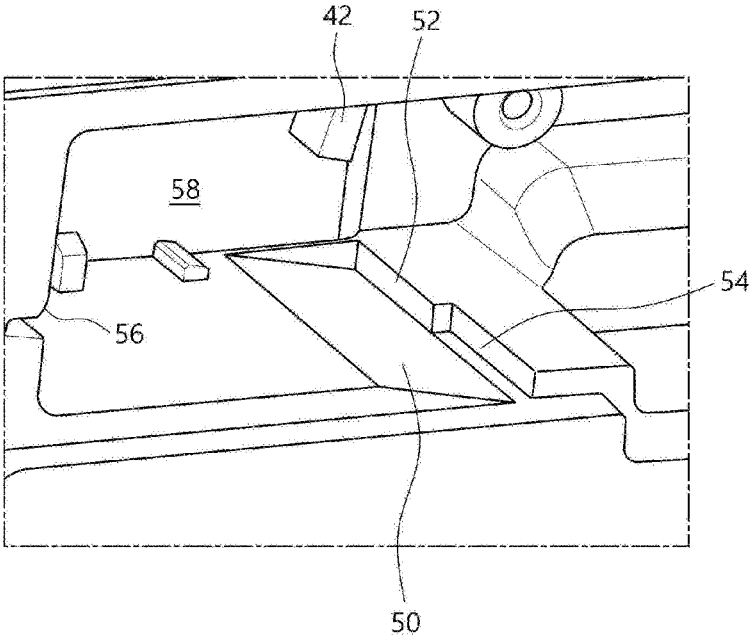
FIG. 7 is a perspective view illustrating an example of a sensor space defined at an end portion finishing member of the refrigerator.
Figure 8:
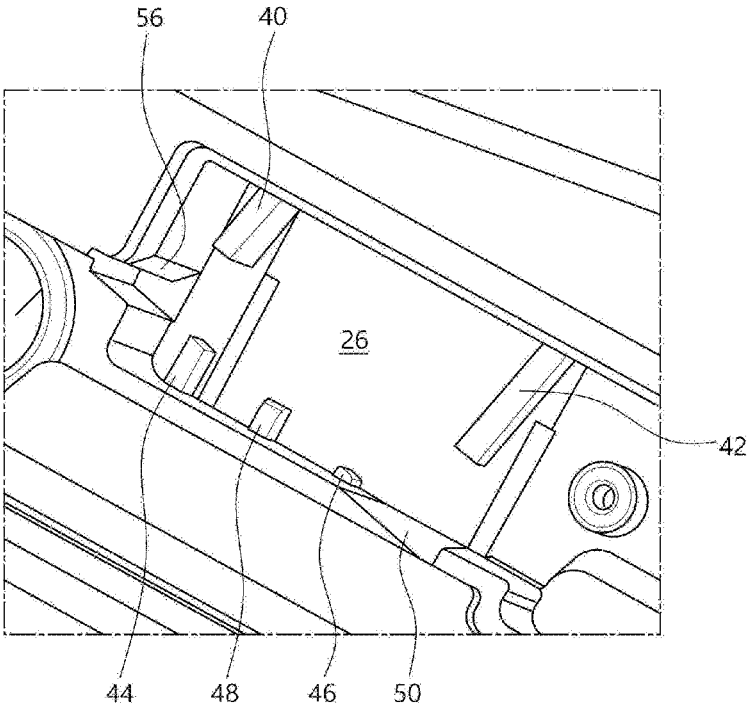
FIG. 8 is a perspective view illustrating the sensor space and the end portion finishing member of the refrigerator viewed from a direction different from the direction of FIG. 7.
Figure 9:
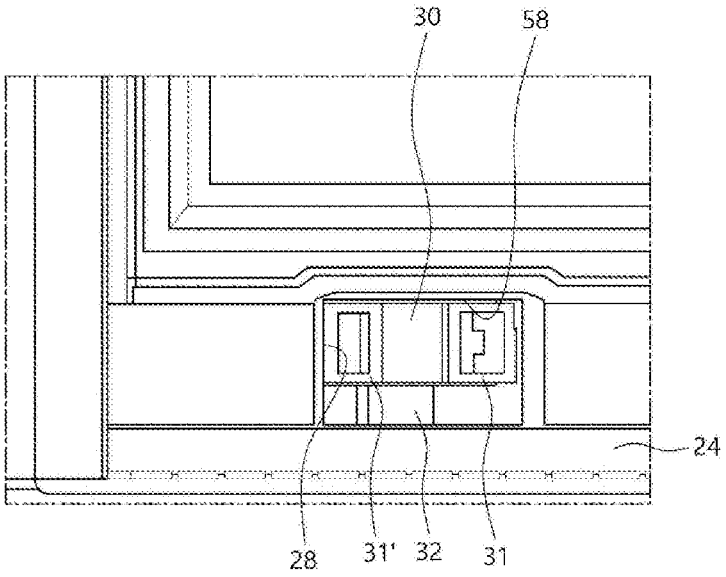
FIG. 9 is a front view illustrating an example part of the refrigerator viewed from a direction of arrow A in FIG. 5.
Figure 10:
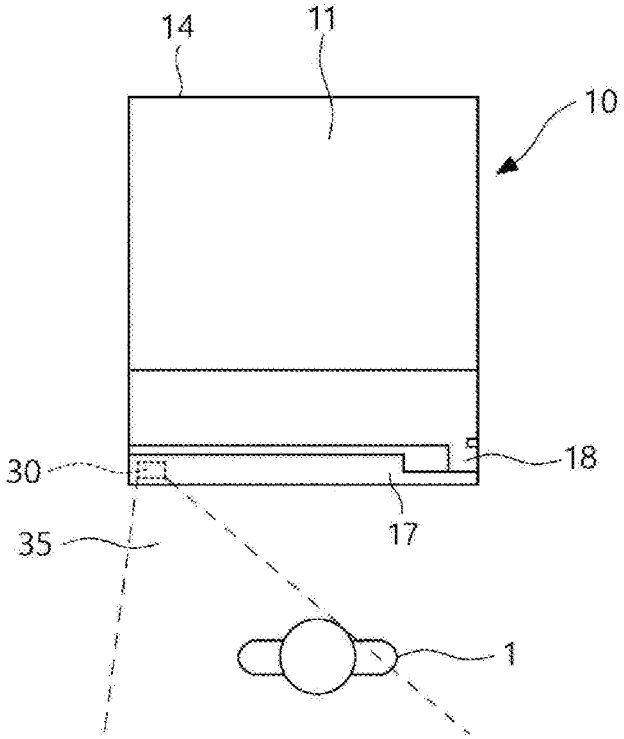
FIG. 10 is a view illustrating an example of the user detection sensor detecting a user.

FIG. 5 is a bottom view illustrating an example part of an inner door viewed from the direction of arrow A. FIG. 6 is a perspective view illustrating an example of a user detection sensor of the refrigerator. FIG. 7 is a perspective view illustrating an example of a sensor space defined at an end portion finishing member of the refrigerator. FIG. 8 is a perspective view illustrating the sensor space in the end portion finishing member of the refrigerator viewed from a direction different from the direction of FIG. 7. FIG. 9 is a front view illustrating a part of the refrigerator viewed from a direction of arrow A in FIG. 5. FIG. 10 is a view illustrating an example of the user detection sensor detecting a user.

Referring to FIGS. 3 to 10, the bottom view illustrating the bottom surface of the inner door 19 is disclosed in FIG. 5. A door front panel 21 may be installed in the front surface of the inner door 19.

The door front panel 21 may be transparent or translucent glass. A door inner part 22 made of synthetic resin may be formed in the rear surface of the inner door 19.

The end portion finishing member 24 may be provided to constitute the lower surface of the inner door 19 by being connected to the door front panel 21 and the door inner part 22. For example, the end portion finishing member 24 may be a plate disposed at a lower surface of the inner door 19.

The end portion finishing member 24 may constitute the lower surface of the inner door 19. In some examples, separate end portion finishing members 24 may define the upper surface and opposite side surfaces of such an inner door 19.

The sensor space 26 having a predetermined shape may be defined in the end portion finishing member 24. The sensor space 26 may be defined in a groove shape. That is, the sensor space 26 may be defined so that the surface of the end portion finishing member 24 is recessed concavely.

A sensor window 28 may be provided at an inner side of the sensor space 26 to face the rear surface of the door front panel 21. Light for sensing can pass through the door front panel 21 by passing through such a sensor window 28.

The user detection sensor 30 may be installed in such a sensor space 26.

A light source part 31 and a light receiving part 31' may be provided in the user detection sensor 30. The front ends of the light source part 31 and the light receiving part 31' may be provided to face the sensor window 28.

A connector 32 may be provided at a side of the user detection sensor 30, and be electrically connected to an external device.

Mounting pieces 33 (e.g., flanges) may be provided at the opposite sides of the rear end of the user detection sensor 30. For instance, referring to FIG. 5, the mounting pieces 33 may include a first-side mounting piece or protrusion that protrudes from a first side of the rear end of the user detection sensor 30 and a second-side mounting piece or protrusion that protrudes from a second side of the rear end of the user detection sensor 30 and that is spaced apart from the first-side mounting piece.

A substrate may be installed in a space defined at the rear end of the user detection sensor 30. The space in which such a substrate is installed may be defined to be open toward the rear of the user detection sensor 30, and the substrate may be installed inside the space.

When the user detection sensor 30 is installed in the sensor space 26, the light source part 31 and the light receiving part 31' are not installed to be orthogonal to the rear surface of the door front panel 21, but may be installed to incline to the rear surface of the door front panel 21.

That is, the light source part 31 and the light receiving part 31' of the user detection sensor 30 may be installed to incline by a predetermined angle to the door front panel 21. The direction in which the user detection sensor 30 is inclined to the door front panel 21 may be changed depending on the position of the user detection sensor 30, but when the user detection sensor 30 is located at any one position of positions corresponding to the opposite end portions of the door front panel 21, the user detection sensor 30 may be provided to incline by a predetermined angle toward a center line C of a vertical direction (see FIG. 2) when the front surface of the door is viewed from the front of the refrigerator.

In some examples, the angle, formed by the front surface of the user detection sensor 30 with respect to the door front panel 21, may be about 10 to 15 degrees so that the front surface of the user detection sensor 30 may be inclined in the direction of the center line C. For example, the angle of the front surface of the user detection sensor 30 may be 12 degrees with respect to the door front panel 21. Such an angle may be determined in consideration of a position at which a user approaches to use a refrigerator according to the size and characteristics of the refrigerator. For example, when the handle of a door of a refrigerator is located at the left of the refrigerator, a user normally approaches the left to open the door by holding the handle, but when a refrigerator has a double door, a user normally approaches the center thereof. Accordingly, in consideration of this, the angle of the user detection sensor 30 is set.

Accordingly, the front surface of the user detection sensor 30 is set to incline with respect to the door front panel in consideration that a user normally stands at a position of the front of a refrigerator corresponding to the center portion of the width direction of the swinging door 17.

For example, when the user detection sensor 30 is installed at the upper end of the swinging door 17, the user detection sensor 30 may be installed to incline toward the bottom of a refrigerator while being directed toward the center line C.

Installing the user detection sensor 30 slantingly with respect to the door front panel 21 is very important in terms of the detection of a user.

For example, if the user detection sensor 30 is not installed to incline in the direction of the center line C, but is installed to be orthogonal to the rear surface of the door front panel 21, the range in which the user detection sensor 30 detects a user may be narrow.

Particularly, when the user detection sensor 30 is installed to be orthogonal to the rear surface of the door front panel 21, the user detection sensor 30 may not detect the user when the user stands at the center portion of the refrigerator or at the right side of the center portion thereof.

The light source part 31 and the light receiving part 31' are provided in the user detection sensor 30. The light source part 31 emits light, the light illuminates a user, and the light reflected by the user is detected by the light receiving part 31', so the presence of the user may be detected.

The user detection sensor 30 may be installed at a side of the swinging door 17 or the inner door 19. In the implementation, the user detection sensor 30 may be installed at a position adjacent to the edge of a side of the inner door 19.

The user detection sensor 30 may be installed at a position relatively far away from a rotation center of the swinging door 17.

The sensor space 26 in which the user detection sensor 30 is installed is defined in a groove shape, and may have components for installing the user detection sensor 30 therein.

A first side guide rib 40 and a second side guide rib 42 may be formed at a ceiling of the sensor space 26 by protruding therefrom.

The first side guide rib 40 and the second side guide rib 42 may extend parallel to each other to be spaced apart by a predetermined interval from each other. The first side guide rib 40 and the second side guide rib 42 support the opposite surfaces of the user detection sensor 30, and the outer surfaces of the light source part 31 and the light receiving part 31' may be located by being in close contact with the first side guide rib 40 and the second side guide rib 42 therebetween.

The first side guide rib 40 and the second side guide rib 42 protrude from the ceiling of the sensor space 26, but do not protrude up to an entrance of the sensor space 26. The first side guide rib 40 and the second side guide rib 42 may protrude up to roughly half the length of the depth of the sensor space 26 relative thereto.

The first side guide rib 40 and the second side guide rib 42 are formed to incline by a predetermined angle relative to the sensor window 28. This angle may be the same as the angle at which the user detection sensor 30 inclines relative to the door front panel 21.

A first rear end support rib 44 and a second rear end support rib 46 may protrude at inner sides of the sensor space facing the inner sides of the sensor space 26 in which the sensor window 28 is provided.

The first rear end support rib 44 and the second rear end support rib 46 may function to support the rear end of the user detection sensor 30.

The first rear end support rib 44 may extend to be longer than the second rear end support rib 46. This is because the user detection sensor 30 is slantingly installed.

A rear end holder 48 may be disposed between the first rear end support rib 44 and the second rear end support rib 46. The rear end holder 48 may be elastically transformed and has a cantilever shape, and can hold a side of an edge of the rear end of the user detection sensor 30.

Since the rear end holder 48 holds the edge of the rear end of the user detection sensor 30, the user detection sensor 30 may be prevented from falling toward the entrance of the sensor space 26.

An interference avoidance inclining surface 50 may be formed at a position adjacent to the second rear end support rib 46 in an inner side of the sensor space 26 in which the rear end holder 48 is formed.

Due to the formation of the interference avoidance inclining surface 50, a mounting piece support end 52 may be formed in an end portion of the interference avoidance inclining surface 50. The mounting piece support end 52 may be a portion with which a first-side mounting piece 33 of the user detection sensor 30 is in close contact.

A portion of the mounting piece support end 52 located at a position adjacent to the entrance of the sensor space 26 is removed so as to form an interference avoidance part 54. For example, the interference avoidance part 54 is an opening or a recess defined at one side of the mounting piece support end 52.

The interference avoidance part 54 is intended to prevent the user detection sensor 30 from being interfered with the mounting piece support end 52 when the user detection sensor 30 is installed in the sensor space 26. That is, when the user detection sensor 30 enters the inside of the sensor space 26 through the entrance thereof, the user detection sensor 30 is allowed to be prevented from being interfered with the mounting piece support end 52.

A holding channel 56 may be formed at an inner side of the sensor space 26 at a position opposite to a position at which the mounting piece support end 52 is located. The holding channel 56 may be formed along the inner side of the sensor space 26 from the entrance of the sensor space 26 to the ceiling thereof.

The first-side mounting piece 33 of the user detection sensor 30 may be inserted into and be held in the holding channel 56. A chamfer is formed on the entrance of the holding channel 56 so that the mounting piece 33 is efficiently inserted into the holding channel 56.

In some examples, a separate cover may be provided to cover the sensor space 26. Such a cover allows the sensor space 26 and the user detection sensor 30 to be prevented from being exposed to the outside, and prevents the user detection sensor 30 from being randomly removed from the sensor space 26.

Since the user detection sensor 30 is located in the sensor space 26 to incline by a predetermined angle, the cover covering the sensor space 26 and the connector 32 may interfere with each other. To prevent this, the user detection sensor 30 may be located at a further inner side of the sensor space with respect to the cover.

In some implementations, as illustrated in FIGS. 5 and 7, the ceiling of the sensor space 26 is concavely recessed, and an interference avoidance groove 58 may be famed.

Due to the presence of such an interference avoidance groove 58, the connector 32 of the user detection sensor 30 and the cover may be prevented from being interfered with each other. This may mean that the cover may be used in common with the interference avoidance groove 58 without being separately designed and made.

In addition, due to the ceiling recessed concavely, a portion opposite to the ceiling may protrude upward relative to the ceiling of FIG. 7. Accordingly, since the interference avoidance groove 58 is formed in the ceiling, the corresponding portion of a heater installed at a position adjacent to the end portion finishing member 24 may be arranged to be curved.

Hereinafter, in the refrigerator of the present disclosure having the configuration described above, the way in which the user detection sensor 30 is installed and used, and the control method of a refrigerator of the present disclosure will be described in further detail.

In the refrigerator of the present disclosure, the user detection sensor 30 is intended to detect a user who intends to use the refrigerator.

As illustrated in FIG. 10, when a user 1 approaches the front of the refrigerator, the user detection sensor 30 can detect the user.

As illustrated in FIG. 10, the user detection sensor 30 may be installed such that a detection area 35 inclines to the right, that is, such that the detection area 35 further inclines by a predetermined angle in a right direction. This is intended to detect the user 1 even when the user approaches the center of the refrigerator or the right thereof.

In the implementation of present disclosure, when the user 1 approaches the front of the swinging door 17, light emitted from the light source part 31 of the user detection sensor 30 illuminates the user 1, and the light reflected from the user 1 is received in the light receiving part 31', so that the presence of the user 1 may be detected.

As described above, in the implementation of the present disclosure, the user detection sensor 30 may be installed on the rear surface of the door front panel 21 of the inner door 19.

Particularly, the user detection sensor 30 is installed at a position corresponding to an edge of a side of the lower end portion of the inner door 19, but is installed to incline toward the center line C of the door front panel 21. Accordingly, the user detection sensor 30 can detect a user 1 although the user is present at the center of the swinging door 17 or at a right side thereof.

In some implementations, in the implementation of the present disclosure, the user detection sensor 30 may be provided in the sensor space 26 open toward the lower surface of the inner door 19.

As illustrated in FIG. 5, the user detection sensor 30 may be provided inside the sensor space 26 to incline by a predetermined angle.

When the user detection sensor 30 is inserted into the sensor space 26, first, at the entrance of the sensor space 26, the rear end of the user detection sensor 30 may be provided to be parallel to the inner side at which the rear end holder 48 is formed.

In this state, the user detection sensor 30 is inserted into the sensor space 26, and the light source part 31 and the light receiving part 31' are allowed to be seated on the first side guide rib 40 and the second side guide rib 42, respectively.

Next, the light source part 31 and the light receiving part 31' are located between the first side guide rib 40 and the second side guide rib 42 by rotating the user detection sensor 30 by a predetermined angle clockwise relative to the position of the user detection sensor 30 in FIG. 5.

In some implementations, one of the mounting pieces 33 is allowed to enter the holding channel 56, and the other of the mounting pieces 33 is allowed to be in contact with a side surface of the mounting piece support end 52.

Accordingly, when the user detection sensor 30 is rotated in the sensor space 26, the rear end of the user detection sensor 30 is supported by the first rear end support rib 44 and the second rear end support rib 46, and the rear end holder 48 may hold the edge of the rear end of the user detection sensor 30.

As described above, when the user detection sensor 30 is placed in the sensor space 26, the light source part 31 and the light receiving part 31' may be placed to incline by predetermined angles with respect to the sensor window 28.

When the user detection sensor 30 is installed in the sensor space 26, and is in a state in which the user detection sensor 30 can transmit a detection signal to the controller through the connector 32, the sensor space 26 may be covered by the cover.

In some implementations, when a user is detected by the user detection sensor 30, the button device 20 may be activated. For example, when the user is detected, the user detection sensor 30 may transmit the detection signal to the controller 60, and the controller 60 may activate the button device 20.

When the button device 20 is activated, the light emitter 224 provided in the button device 20 is turned on. When the light emitter 224 is turned on, the light emitter 224 can emit light. The activation of the button device 20 and the emission of light by the light emitter 224 may be performed simultaneously or with a very short time interval.

Figure 11:
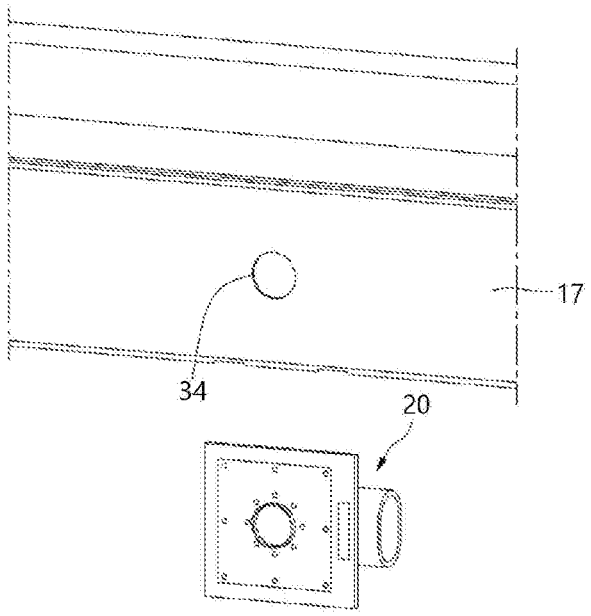
FIG. 11 is a view illustrating an example of a button device separated from a swinging door of the refrigerator.
Figure 12:
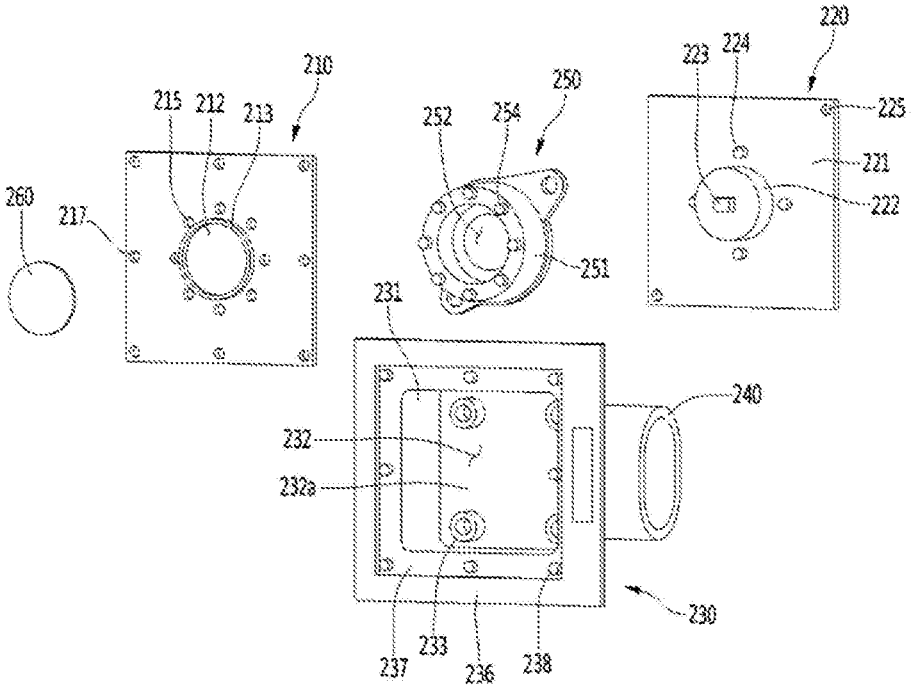
FIG. 12 is an exploded perspective view illustrating the button device.

FIG. 11 is a view illustrating an example of a button device separated from a swinging door, and FIG. 12 is an exploded perspective view illustrating the button device.

Referring to FIGS. 11 and 12, the button device 20 may be located at the lower portion of the swinging door 17.

A front frame may be installed in the swinging door 17 to support the button device 20, and a button hole 34 may be provided in the front frame so as to expose a portion of the button device 20 to the outside. For example, an area corresponding to an area of at least a button 212 of a button part 210 may be exposed to the outside through the button hole 34.

The button device 20 may include the button part 210 having the button 212, and a detection part 220 detecting the manipulation of the button 212.

For example, the button part 210 may be formed of an elastic material that may be transformed by external force. For example, the button part 210 may be formed of silicon.

The button 212 has a predetermined area, and may be famed in a circular or polygonal shape.

In FIG. 12, for example, the button 212 is formed in a circular shape.

A plurality of holes 215 may be formed along a circumferential direction of the button 212. For example, the plurality of holes 215 may be spaced apart by predetermined radii from the center of the button 212, and may be arranged at predetermined intervals Accordingly, an imaginary line connecting the plurality of holes 215 to each other is circular, and the button 212 is positioned within an area in which the plurality of holes 215 is formed.

The pressing force of the user is transmitted to the button 212, and the button 212 may be transformed in a direction away from the direction in which the pressing force is applied since the button part 210 is formed of the elastic material.

Since the plurality of holes 215 is arranged at the predetermined intervals along the circumference of the button 212, the button 212 may be efficiently transformed although the pressing force applied to the button 212 is focused to any one side.

In addition, even after the button 212 is transformed by repeated pressing force due to the plurality of holes 215 arranged along the circumference of the button 212, the button 212 may be easily restored to an initial state thereof.

Furthermore, although an excessive force is applied to the button 212, the force may be dispersed to the plurality of holes 215, so plastic deformation of the button 212 may be prevented.

The button part 210 including the button 212 may be famed in a rectangular or square shape as a whole.

The button part 210 may further include a protruding part 213 extending from the circumference of the button 212. The protruding part 213 may be located within the area in which the plurality of holes 215 is formed.

The protruding part 213 may be formed in the shape of a circular ring as an example. The protruding part 213 can pass through the button hole 34.

A diameter of the button hole 34 of the front frame may be the same as or smaller than an outer diameter of the protruding part 213. Accordingly, while the protruding part 213 is in a state of passing through the button hole 34, the protruding part 213 completely covers the button hole 34, so water of the outside is prevented from passing through the button hole 34. Accordingly, the waterproof performance of the button device 20 may be improved.

A contact part 260 with which a user is in contact to press the button 212 may be coupled to the protruding part 213. The contact part 260 may be configured in a shape of a disc as an example, and the thickness thereof may be thinner than the protruding length of the protruding part 213.

The outer diameter of the contact part 260 may be the same as or larger than the inner diameter of the protruding part 213.

Accordingly, the contact part 260 is received into space defined by the protruding part 213, and the state of the contact part 260 fitted into the protruding part 213 may be maintained due to a frictional force of the contact part with the protruding part 213.

When the contact part 260 is received into the space defined by the protruding part 213, the contact part 260 may be in contact with the button 212.

While the contact part 260 is received into the space of the protruding part 213, the contact part 260 may be prevented from being removed from the protruding part 213.

In the implementation, while the contact part 260 is fitted into the protruding part 213, the contact part 260 may be located at a position of the button hole 34. Accordingly, the contact part 260 may be prevented from protruding forward from the swinging door 17.

The contact part 260 may be formed of a material different from the material of the button part 210. When the contact part 260 is formed of the material different from the material of the button part 210, a user can easily recognize the contact part 260.

The detection part 220 may include the substrate 221, a switch 222 installed on such a substrate 221, one or more light emitters 224 arranged around the switch 222.

The detection part 220 may be located behind the button part 210, and the switch 222 may be arranged to face a pressing part 214.

In the state in which an external force is not applied to the button 212 (a state in which the button is not manipulated), a contact point 223 of the switch 222 may be in contact with the pressing part 214, or may be spaced apart therefrom. In some examples, while an external force is not applied to the button 212, the contact point 223 is not pressed by the pressing part 214 although the contact point 223 of the switch 222 is in contact with the pressing part 214.

In some implementations, where the manipulation force of the button 212 is transmitted directly to the switch 222 through the pressing part 214, a path through which the manipulation force of the button 212 is transmitted to the switch 222 is short, which leads to a simple structure of the button device 20, so the button device 20 becomes compact.

As an example, the plurality of light emitters 224 may be installed on the substrate 221.

The switch 222 may be located between the plurality of light emitters 224. Alternatively, the plurality of light emitters 224 may be arranged to surround the switch 222.

The button device 20 may further include a housing 230 receiving the detection part 220.

The housing 230 may have a receiving space 232 receiving the detection part 220.

A plurality of supporting protrusions 233 supporting the substrate 221 may be provided in a bottom wall 232*a* of the receiving space 232. Accordingly, each of the supporting protrusions 233 protrudes from the bottom wall 232*a*, and thus the substrate 221 may be spaced apart from the bottom wall 232*a*.

Fastening holes 225 through which fastening members are fastened to the supporting protrusions 233 may be famed in the substrate 221. The fastening holes 225 may be aligned with some protrusions of the plurality of supporting protrusions 233.

Accordingly, the fastening members pass through the fastening holes 225, and may be fastened to some protrusions of the supporting protrusions 233 of the plurality of supporting protrusions 233.

The housing 230 can support the button part 210. The housing 230 may include a housing body 231 having the receiving space 232 defined therein, and an edge part 236 extending from an edge of the housing body 231.

The edge part 236 may support the button part 210, and such a button part 210 may cover the receiving space 232. The edge part 236 may include a seating part 237 having a recessed shape to seat the button part 210 therein.

Fixing protrusions 238 may be formed in the seating part 237, and protrusion holes 217 into which the fixing protrusions 238 are inserted may be formed in the button part 210.

The housing 230 may include an electric wire guide 240 guiding an electric wire connected to the substrate 221.

Guiding space may be formed inside the electric wire guide 240, and such a guiding space may communicate with the receiving space 232.

In some implementations, the button device 20 may include a reflecting member 250, the reflecting member reflecting light emitted from the light emitter 224.

The reflecting member 250 may include a reflecting member body 251 having a passageway 252 defined therein.

The passageway 252 allows the light emitted from the light emitter 224 and the light reflected from the reflecting member 250 to flow.

The reflecting member body 251 may be in contact with the substrate 221, and may surround the light emitter 224 and the switch 222 located on the substrate 221. For example, when the reflecting member body 251 is in contact with the substrate 221, the light emitter 224 and the switch 222 may be located in the passageway 252 inside the reflecting member body 251.

The reflecting member 250 may support the button part 210. Protrusions 254 may be provided on a supporting surface of the reflecting member body 251 supporting the button part 210 so that the reflecting member 250 and the button part 210 are coupled to each other.

The protrusions 254 may be coupled to at least some holes of the plurality of holes 215 described above.

In FIG. 12, as an example, a plurality of protrusions 254 is formed to have the same number as the number of a plurality of holes 215, so each of the plurality of protrusions 254 may be coupled to each of the plurality of holes 215.

When the reflecting member body 251 supports the button part 210, the pressing part 214 may be received into the reflecting member body 251. That is, the pressing part 214 may be located in the passageway 252.

After light emitted from the light emitter 224 is reflected in the reflecting member body 251, the light may light the vicinity of the button 212.

In the implementation, the button part 210 may be formed of a translucent material, and the light emitted from the light emitter 224 may light the button part 210.

When the button device 20 is installed on the swinging door 17, the protruding part 213, which is a part of the button device 20, may be exposed to the outer side of the swinging door 17.

Accordingly, light emitted from the light emitter 224 reaches the protruding part 213, and a user checks the light reaching the protruding part 213, and can recognize the protruding part 213 and the contact part 260.

However, when the light emitted from the light emitter 224 directly reaches the button part 210, particularly, the vicinity of the button 212 without being reflected by another structure, the light does not reach the entirety of the protruding part 213, but reaches only some portions of the protruding part 213.

Accordingly, the light does not light uniformly on the protruding part 213.

Contrarily, in the implementation, when the light reaches the vicinity of the button 212 after the light emitted from the light emitter 224 is reflected from the inner circumferential surface 251*a* of the reflecting member body 251, the light does not focus on some portions of the protruding part 213, so the light uniformly lights on the entirety of the protruding part 213.

In the implementation, since the plurality of holes are formed along the circumference of the button to which the manipulation force of a user is transmitted, the button may be prevented from being deformed despite the repeated pressing of the button. In addition, after the light emitted from the light emitter is reflected by the reflecting member, the light illuminates the button part, so the light uniformly lights the circumference of the button.

In some implementations, the button device 20 may be activated by the controller 60. Specifically, as described above, in the refrigerator, when the user detection sensor 30 detects a user, the user detection sensor 30 can transmit the detection signal to the controller 60.

Accordingly, when the controller 60 receives the detection signal, the controller 60 activates the button device 20, and allows the light emitter 224 of the button device 20 to be turned on so that the light emitter emits light.

Accordingly, a user can manipulate the button device 20 so that when a user approaches the refrigerator to use the refrigerator, first, the user detection sensor 30 detects the user, and when the user is detected, the light emitter 224 of the button device 20 is turned on to emit light.

When the button device 20 is activated and the light emitter 224 emits light by being turned on, the information that the button device 20 is activated may be audibly output through the speaker 61, or may be visibly displayed through the display 62.

Accordingly, when the button device 20 is activated, a user may be informed of the activation of the button device through light emission, sound, or displaying, etc., and may be induced to manipulate the button device 20.

Although the implementations of the present disclosures have been described above with reference to the accompanying drawings, the present disclosure is not limited to the above implementations, and may be manufactured in various different foams. Those skilled in the art to which the present disclosure belongs will understand that the present disclosure may be implemented in other specific forms without changing the technical spirit or essential characteristics of the present disclosure. Therefore, it should be understood that the implementations described above are illustrative in all respects and not restrictive.

As the refrigerator becomes multifunctional and intelligent, the refrigerator is becoming larger. Accordingly, as the storage space for storing food increases, the electrical and mechanical devices associated with each of the storage spaces become complex.

The storage space of the drawer may be provided in not only a normal household refrigerator, but also in exclusive use refrigerators such as a kimchi refrigerator, and a wine refrigerator.

This specification describes the storage space of the drawer provided in the normal household refrigerator as an example. However, the present disclosure may be applied to various devices to which the storage space of the drawer is applied.

What is claimed is:

1. A refrigerator comprising:

a cabinet that defines a storage space therein;

a door configured to open and close at least a portion of the storage space, the door comprising a door front panel that defines a front surface of the door; and a user detection sensor disposed at a first side of the door with respect to a center line crossing a width direction of the door and configured to detect a user, the user detection sensor being inclined with respect to the front surface of the door by a predetermined angle to thereby face toward the center line, wherein the door defines a sensor space that receives the user detection sensor at a rear side of the door front panel of the door, the sensor space having a groove shape recessed concavely from the rear side of the door front panel of the door.

2. The refrigerator of claim 1, wherein the door is configured to rotate about a rotation axis, and wherein the user detection sensor is located at an end of the door opposite to the rotation axis.

3. The refrigerator of claim 1, wherein the door comprises sensor window that is disposed at an inner side of the sensor space and faces the rear side of the door front panel, and wherein a front end of the user detection sensor faces the sensor window.

4. The refrigerator of claim 3, wherein the door further comprises a first side guide rib and a second side guide rib that are disposed inside the sensor space at positions corresponding to ends of the sensor window, the first side guide rib and the second side guide rib extending parallel to each other and being inclined with respect to the rear side of the door front panel, and wherein the first side guide rib and the second side guide rib support side surfaces of the front end of the user detection sensor.

5. The refrigerator of claim 4, wherein the door further comprises:

a first rear end support rib and a second rear end support rib that are disposed inside the sensor space at positions rearward relative to the sensor window and that support a rear end of the user detection sensor, the first rear end support rib and the second rear end support rib protruding from a rear surface of the sensor space toward the sensor window and having protrusion lengths different from each other; and a rear end holder that has a cantilever shape and holds the rear end of the user detection sensor.

6. The refrigerator of claim 5, wherein the door further comprises:

an interference avoidance inclining surface that is disposed adjacent to the second rear end support rib at the rear surface of the sensor space; and a mounting piece support end that is disposed at an end portion of the interference avoidance inclining surface, and wherein the user detection sensor comprises:

a first-side mounting piece supported by the mounting piece support end in the sensor space, and a second-side mounting piece that is received in a holding channel defined at a side of the sensor space.

7. The refrigerator of claim 6, wherein the door defines an interference avoidance opening at a portion of the mounting piece support end to thereby avoid interference between the user detection sensor and the mounting piece support end based on the user detection sensor being inserted into the sensor space.

8. The refrigerator of claim 3, wherein the door defines an interference avoidance groove that is recessed from a ceiling of the sensor space such that an opposite surface of the interference avoidance groove protrudes away from the sensor space.

9. The refrigerator of claim 1, further comprising:

a button device disposed at a second side of the door and configured to open the door or lift a container disposed inside the door based on the user manipulating the button device.

10. The refrigerator of claim 9, wherein the button device is configured to be activated based on the user detection sensor detecting the user.

11. The refrigerator of claim 10, wherein the button device comprises a light emitter that is configured to be turned on and emit light based on the button device being activated.

12. The refrigerator of claim 11, wherein the light emitter is configured to be turned off based on an elapse of a preset time without manipulation of the button device after the light emitter has been turned on.

13. The refrigerator of claim 11, wherein the light emitter is configured to:

maintain emission of the light based on manipulation of the button device after the light emitter is turned on; and be turned off based on completion of opening of the door or lifting of the container.

14. The refrigerator of claim 11, wherein the light emitter is configured to, based on the button device being manipulated after the light emitter is turned on, be repeatedly turned on and off while the door is being opened or the container is being lifted.

15. The refrigerator of claim 9, further comprising:

at least one of a speaker or a display, the speaker or the display being configured to, based on the button device being activated, output information indicating the activation of the button device.

16. A method for controlling a refrigerator, the method comprising:

detecting presence of a user in an area around a door of the refrigerator by a user detection sensor that is arranged at a side of the door with respect to a center line crossing a width direction of the door, the user detection sensor being inclined with respect to a front surface of the door by a predetermined angle to thereby face toward the center line, wherein the door includes a door front panel that defines the front surface of the door, the door defining a sensor space that receives the user detection sensor at a rear side of the door front panel of the door, the sensor space having a groove shape recessed concavely from the rear side of the door front panel of the door; and based on detecting the presence of the user, activating a button device that is configured to, based on the user manipulating the button device, open the door or lift a container disposed inside the door.

17. The method of claim 16, further comprising:

based on the button device being activated, turning on a light emitter disposed in the button device to emit light.

18. The method of claim 17, further comprising:

turning off the light emitter based on an elapse of a preset time without manipulation of the button device after the light emitter has been turned on.

19. The method of claim 17, further comprising:

maintaining the light emitter to emit the light based on the button device being manipulated after the light emitter is turned on; and turning off the light emitter based on completion of opening of the door or lifting of the container.

20. The method of claim 16, further comprising:

based on the button device being activated, outputting, through a speaker or a display, information indicating the activation of the button device.

21. The refrigerator of claim 1, wherein the door front panel is made of transparent or translucent glass.

22. The refrigerator of claim 21, wherein the door further comprises an inner door and an end portion finishing member that defines a lower surface of the inner door, and wherein the door front panel is disposed at a front surface of the inner door and connected to the end portion finishing member.

* * * * *